US007571733B1

(12) United States Patent
Brozio, Jr.

(10) Patent No.: US 7,571,733 B1
(45) Date of Patent: Aug. 11, 2009

(54) WATERBLASTING SAFETY CAGE

(75) Inventor: Roy E. Brozio, Jr., Maroa, IL (US)

(73) Assignee: Bodine Services of Decatur Inc., Decatur, IL (US)

( * ) Notice: Subject to any disclaimer, the term of this patent is extended or adjusted under 35 U.S.C. 154(b) by 206 days.

(21) Appl. No.: 11/890,208

(22) Filed: Aug. 3, 2007

Related U.S. Application Data

(60) Provisional application No. 60/835,301, filed on Aug. 3, 2006.

(51) Int. Cl.
*B08B 9/023* (2006.01)

(52) U.S. Cl. ..... 134/22.12; 134/22.18; 134/25.1

(58) Field of Classification Search ..... None
See application file for complete search history.

(56) References Cited

U.S. PATENT DOCUMENTS

| | | | | |
|---|---|---|---|---|
| 3,582,057 | A * | 6/1971 | Beals et al. | 266/226 |
| 3,910,359 | A | 10/1975 | Childress | 173/165 |
| 4,381,027 | A | 4/1983 | Molen et al. | 157/1 |
| 4,505,593 | A | 3/1985 | Miller et al. | 366/152 |
| 6,626,195 | B1 | 9/2003 | Garman et al. | 134/104.1 |

* cited by examiner

*Primary Examiner*—Michael Barr
*Assistant Examiner*—Ryan Coleman
(74) *Attorney, Agent, or Firm*—Philip L. Bateman

(57) ABSTRACT

A safety cage is used in waterblasting with a lance comprising a hollow rod and a nozzle having a diameter larger than the diameter of the rod. The safety cage is an enclosure having an open bottom and a transparent top. The top has a slot and a means for allowing movement through the slot of the rod but not the nozzle of the lance.

5 Claims, 3 Drawing Sheets

WATERBLASTING SAFETY CAGE

CROSS-REFERENCE TO RELATED APPLICATION

This application claims the benefit of U.S. Provisional Application Ser. No. 60/835,301, Aug. 3, 2006.

FIELD OF THE INVENTION

This invention relates to the cleaning of solids with liquids. More particularly, this invention relates to a safety cage for use during waterblasting the tubes of a tube-and-shell heat exchanger.

BACKGROUND OF THE INVENTION

Pressurized water is commonly used for cleaning solid surfaces. The use of extremely high pressure water (20,000 psi or more) for industrial cleaning is commonly known as waterblasting. FIG. 1 illustrates conventional waterblasting equipment. The equipment includes a hose A that carries high-pressure water from a high-pressure pump (not shown), a foot-operated valve B, and a lance C. The lance consists of a hollow metal rod D having a knurled handle E threaded onto its proximate end and a nozzle F with a small orifice threaded onto its distal end. Water exiting the lance is at such a high velocity that it can cause serious injury to person and property. Persons who conduct waterblasting wear heavy protective equipment, but can still be seriously injured if hit by a direct spray.

Tube-and-shell heat exchangers are widely used in industry. In a tube-and-shell heat exchanger, one fluid flows through the inside of multiple parallel metal tubes while another fluid at a different temperature flows outside the tubes. Heat is transferred from the hotter fluid to the cooler fluid as the fluids flow through the heat exchanger. Tube-and-shell heat exchangers are sometimes known as heaters, evaporators, coolers, condensers, etc. depending on the desired effect on the fluid of greatest economic importance.

Many industrial tube-and-shell heat exchangers are operated with fluids that cause deposits to form on the inside of the tubes. These deposits adversely affect the rate of heat transfer and, if substantial enough, can even affect flow rates. Periodic cleaning by waterblasting is commonly performed to remove these deposits.

FIG. 2 illustrates the cleaning of tubes G in a vertical heat exchanger H with conventional waterblasting equipment. A worker J wearing protective equipment holds the lance, inserts it into a tube, opens the food-operated valve, and then moves the lance up and down (or back and forth in a horizontal heat exchanger) along the tube to dislodge the deposits from the tube. When cleaning of the tube is completed, the foot-operated valve is closed, and the lance is removed. The lance is then inserted into another tube, the foot-operated valve is reopened, and another tube is cleaned.

This waterblasting procedure suffers from one very serious danger. If the worker performing the waterblasting accidentally withdraws the lance out of the tube without shutting off the valve (which can happen if the worker forgets to close the valve or if the worker is cleaning the portion of the tube near the proximate end and inadvertently withdraws the lance too far), the high velocity flow of the water against the edge of the tube causes the lance to be propelled backwards with a tremendous force. The lance can be dislodged from the grip of the worker and then whip about in an uncontrolled manner. If a worker is hit by the water flow or by the lance, serious injury or death can result.

Garman et al., U.S. Pat. No. 6,626,195, Sep. 30, 2003, discloses a waterblasting apparatus in which the lance is moved with a mechanical apparatus rather than manually. The apparatus is so large, heavy, cumbersome, and expensive that it is unsuitable for use in most situations. A number of safety cages, guards, and the like have been disclosed for various purposes. Examples include the devices disclosed in Childress, U.S. Pat. No. 3,910,359, Oct. 7, 1975; Molen et al., U.S. Pat. No. 4,381,027, Apr. 26, 1983; and Miller et al., U.S. Pat. No. 4,505,593, Mar. 19, 1985. However, these devices are not suited for use in waterblasting.

Accordingly, a demand exists for a way of eliminating the danger of an uncontrolled lance when manual waterblasting of a tube-and-shell heat exchanger is being conducted.

SUMMARY OF THE INVENTION

One general object of this invention is to provide an improved safety cage for use while waterblasting the tubes of a tube-and-shell heat exchanger. Another general object of this invention is to provide an improved method of waterblasting the tubes of a tube-and-shell heat exchanger.

I have invented an improved safety cage for use in waterblasting with a lance comprising a hollow rod and a nozzle having a diameter larger than the diameter of the rod. The safety cage comprises an enclosure with an open bottom and a transparent top, the top having a slot and a means for allowing movement through the slot of the rod but not the nozzle of the lance.

I have also invented an improved method of waterblasting the tubes of a tube-and-shell heat exchanger. The method comprises: (a) obtaining a lance comprising a hollow rod having a diameter and a nozzle having a diameter greater than the diameter of the rod; (b) obtaining a safety cage comprising an enclosure with an open bottom and a transparent top, the top having a slot and a means for allowing movement through the slot of the rod but not the nozzle of the lance; (c) passing the lance through the slot in the safety cage such that the nozzle is contained within the cage and the rod extends outwardly through the slot; (d) connecting the lance to a source of high pressure water which flow is regulated by a valve; and (e) placing the cage over a tube, inserting the lance into the tube, opening the valve, and discharging high pressure water into tube.

The use of the safety cage of this invention eliminates the danger of an uncontrolled lance during waterblasting.

DETAILED DESCRIPTION OF THE INVENTION

This invention is best understood by reference to the drawings. Referring first to FIGS. 3 to 7, a first embodiment 100 of the safety cage comprises an enclosure whose purpose is to allow a waterblasting lance to be used in the conventional manner, but to contain the nozzle of the waterblasting lance if the worker loses his grip on the lance. The enclosure has an open bottom, a cylindrical vertical side 111, and a transparent top 112 with a slot 113. The components are discussed in more detail below.

The shape of the enclosure is a matter of choice and cylinders, domes, boxes, and the like are suitable. The preferred shape of the enclosure is cylindrical with a flat top as shown in the first embodiment. A cylindrical enclosure generally has a diameter of about four to eighteen inches, preferably about six to fourteen inches. It generally has a height of about four to twelve inches, preferably about five to eight inches. The enclosure is preferably made of a durable, heavy material. The preferred material is ten gage sheet metal. The enclosure is partially or completely open at the bottom so movement of the lance is not constricted. The enclosure rests flushly upon a flat surface.

All or a substantial part of the top of the enclosure is transparent so the worker can see the lance in the tube. The term "transparent" is used herein to refer to a material that allows sight through it, either because the material itself is transparent or because voids are present in the material. Transparent materials include solid materials, such as polymethyl methacrylates, polycarbonates, and the like. Transparent materials also include meshes, screens, perforated materials, and the like. The top is preferably made of heavy screen, perforated metal sheet, or the like because solid materials tend to get dirty during use which interferes with visibility.

The slot preferably runs across most or all the width of the enclosure. Maximizing the length of the slot maximizes the number of tubes that can be reached with the safety cage. The width of the slot is generally about one-half to two inches. As will be seen, the width of the slot is critical in allowing movement of the rod, but not the nozzle, through the slot.

The total weight of the safety cage is preferably at least about five pounds and is most preferably about ten to twenty pounds. The weight of the safety cage plays an important role in containing the nozzle of the lance if the user loses his grip. The weight must be sufficient to contain the nozzle. However, the safety cage becomes more cumbersome as the weight increases.

Figure 7:
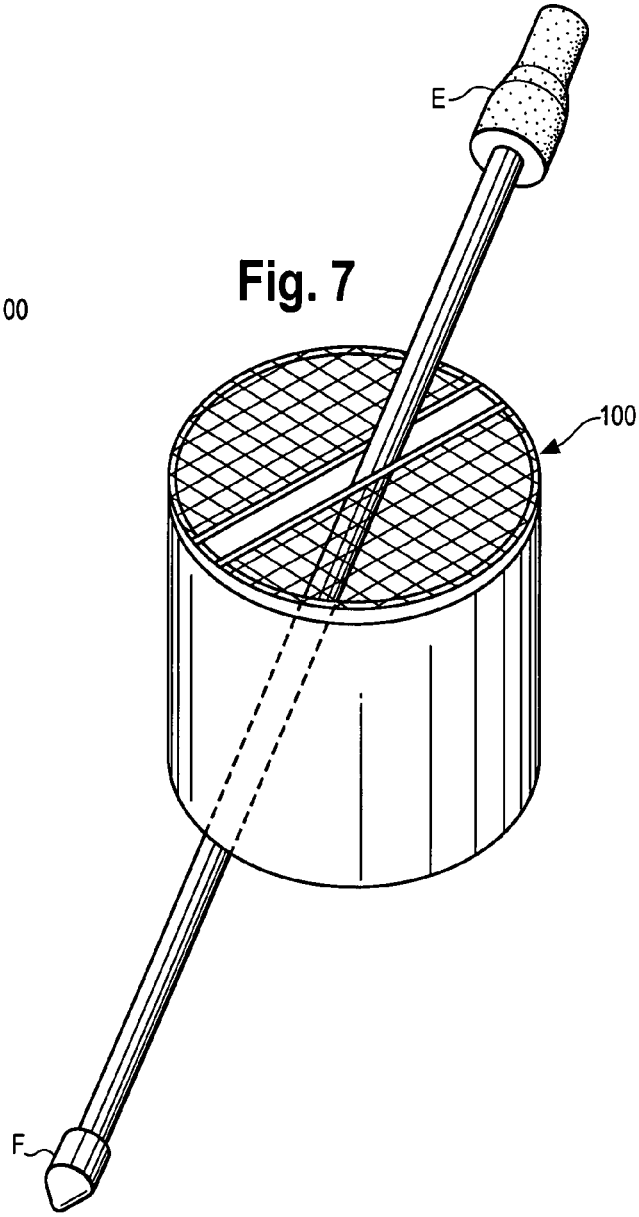
FIG. 7 is a perspective view thereof assembled with conventional water-blasting equipment.
Figure 8:
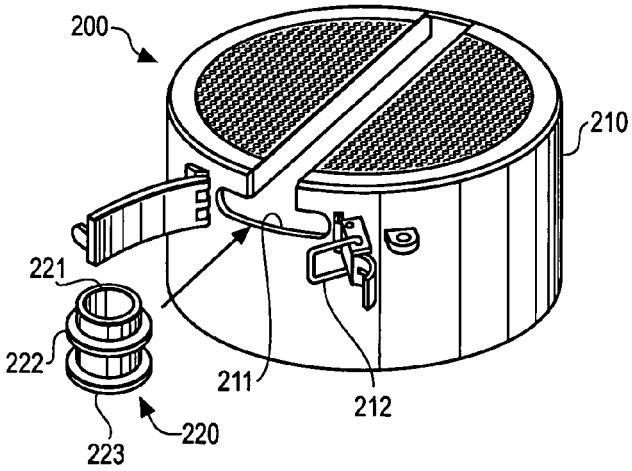
FIG. 8 is a perspective view of a second embodiment of the safety cage.
Figure 9:
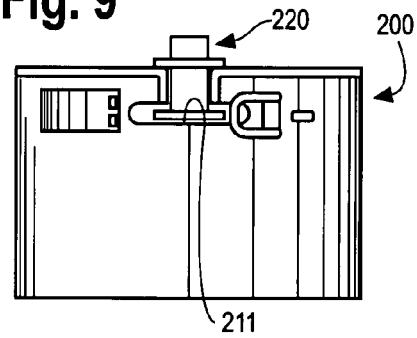
FIG. 9 is side elevation view thereof.
Figure 10:
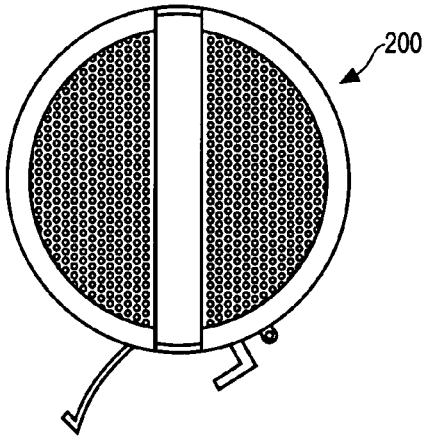
FIG. 10 is a top plan view thereof.
Figure 11:
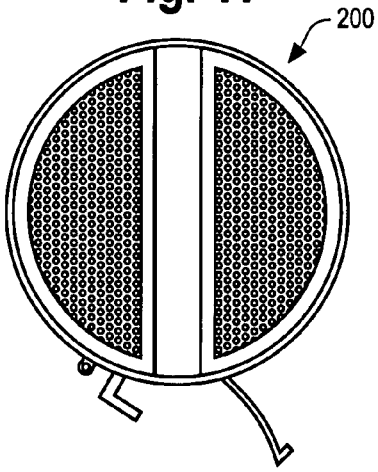
FIG. 11 is a bottom plan view thereof.

The assembly of the safety cage with a conventional waterblasting lance is shown in FIG. 7. The rod is inserted through the slot by removing either the nozzle or handle. The removed item is then reattached. The slot is slightly wider than the rod so that the lance can be moved through the slot. The slot is narrower than both the handle and nozzle so the lance cannot be separated from the safety cage and so that the nozzle is confined within the enclosure if the worker loses his grip on the lance.

The safety cage-lance assembly is used in the same manner as a conventional lance. The worker moves the assembly over the desired tube, inserts the lance into the tube, opens the food-operated valve, and then moves the lance down and up along the tube. If the worker withdraws the lance from the tube without first turning off the valve, the high pressure water stream is largely confined within the cage. In addition, if the worker loses his grip on the lance, the nozzle end of the lance is also confined within the cage. This confinement of the nozzle and spray eliminates the risk of injury to the worker.

Referring now to FIGS. 8 to 12, a second embodiment 200 accommodates lances having a wider range of diameters than the first embodiment. The second embodiment contains two parts, the enclosure 210 and one or more lance guides 220. The enclosure is similar to the first enclosure except that an opening 211 in the side wall provides a means for inserting the guide into the slot. A latch 212 provides a means for closing the opening.

Figure 12:
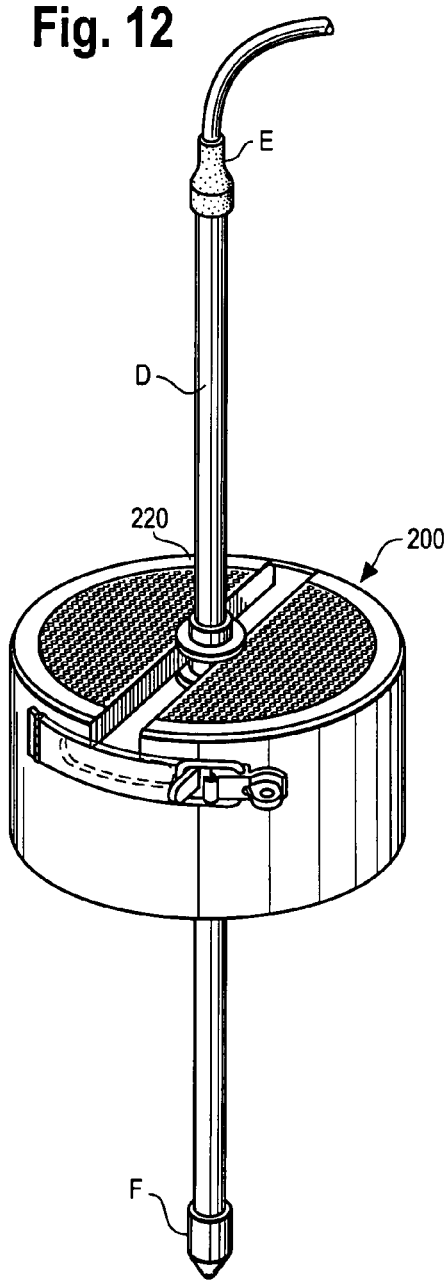
FIG. 12 is a perspective view thereof assembled with conventional water-blasting equipment.

The lance guide is a sleeve 221 with two spaced apart annular flanges 222 and 223 that ride above and below the slot. After the desired guide is placed into the slot of the enclosure, the lance is inserted into the guide in the same manner the lance is inserted into the first embodiment of the safety cage (either the nozzle or the handle is removed, the lance is inserted, and then the removed part is reattached). The lance and guide are then moved along the slot and channel. The assembly is illustrated in FIG. 12. The latch is omitted for clarity.

The major advantage of the second embodiment is that guides adapted for varying diameters of lances can be used with a single safety cage. In other words, when dealing with lances of varying diameters, it is more economical and practical to use a single safety cage and multiple lance guides than to use multiple safety cages. The lance guides are conveniently stored in the slot when not in use.

If desired, a handle is easily attached to the enclosure. If the handle is attached flush to the bottom, it also serves a foot rest which enables the worker to further secure the enclosure in place.

Figure 1:
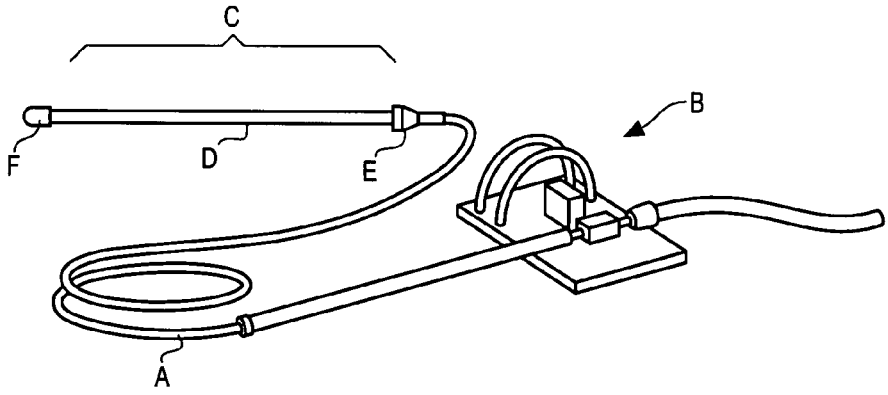
Fig. 1 PRIOR ART
FIG. 1 is a perspective view of prior art waterblasting equipment.
Figure 2:
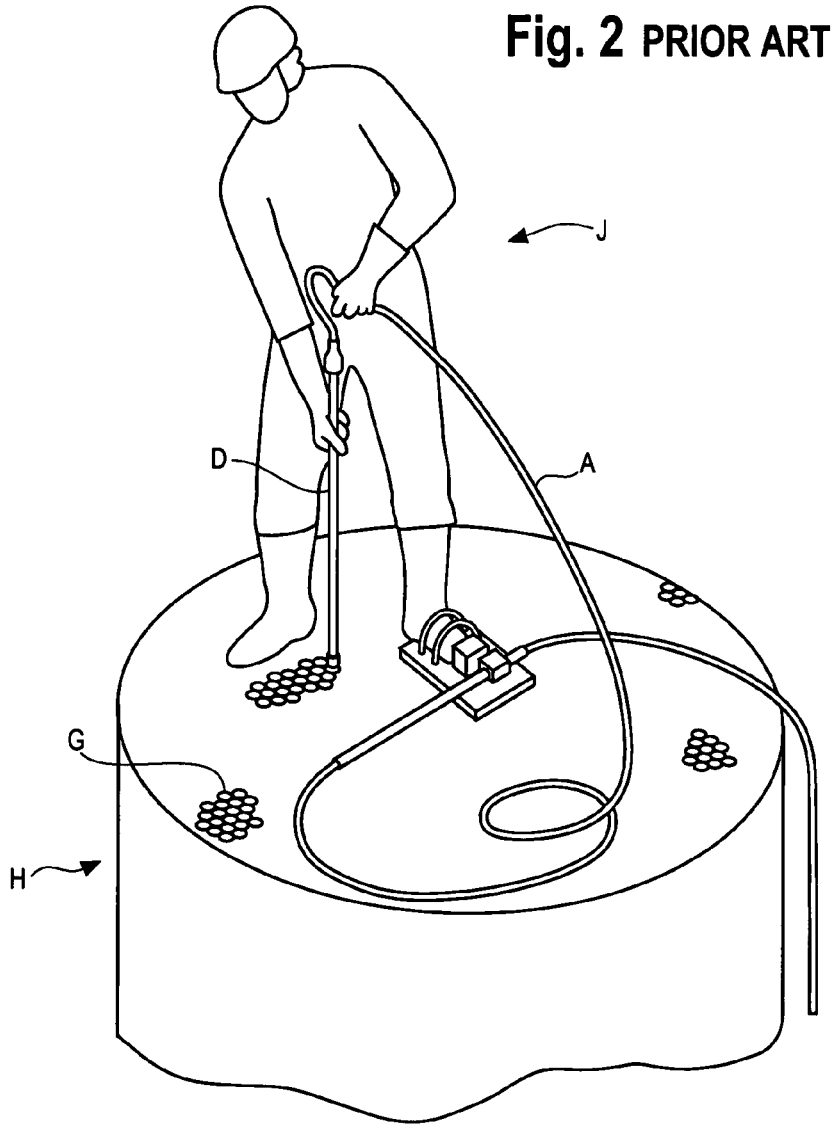
Fig. 2 PRIOR ART
FIG. 2 is a perspective view of a worker cleaning a tube-and-shell heat exchanger using prior art water blasting equipment.
Figure 3:
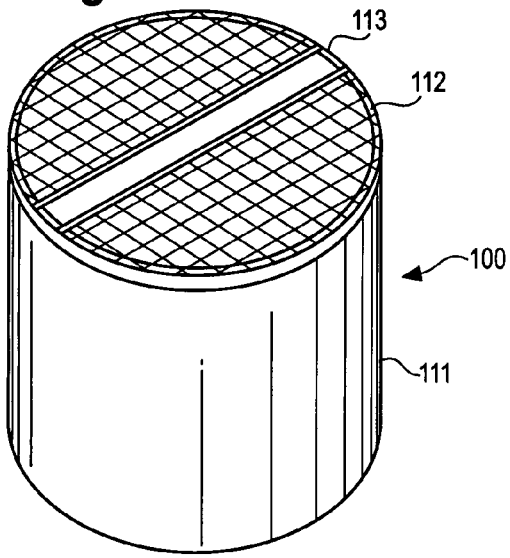
FIG. 3 is a perspective view of one embodiment of the safety cage of this invention.
Figure 4:
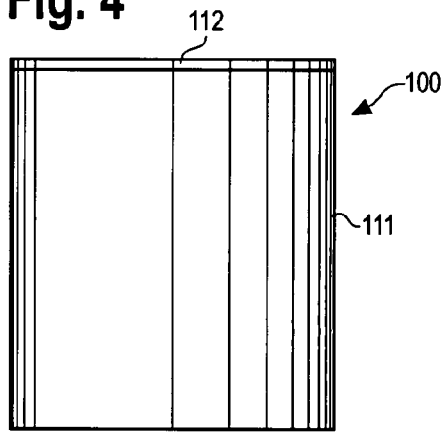
FIG. 4 is a side elevation view thereof.
Figure 5:
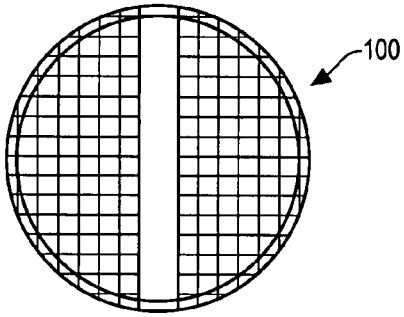
FIG. 5 is a top plan view thereof.
Figure 6:
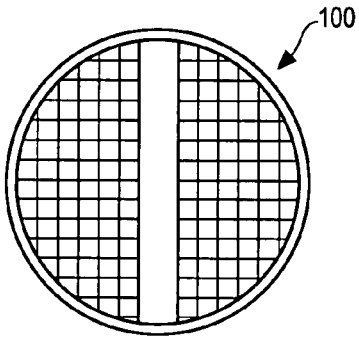
FIG. 6 is a bottom plan view thereof.

The first and second embodiments are especially adapted for use with vertical heat exchangers in which they rest upon a flat, horizontal surface as shown in FIG. 2. To use the safety cage with a horizontal heat exchanger, an appropriate support structure is necessary.

I claim:

1. A method of waterblasting a tube in a tube-and-shell heat exchanger having a plurality of tubes, the ends of which form a flat surface, the method comprising:

(a) obtaining a lance comprising a hollow rod having a diameter and a nozzle having a diameter greater than the diameter of the rod;

(b) obtaining a safety cage comprising an enclosure with an open bottom and a transparent top, the top having a slot and a means for allowing movement through the slot of the rod but not the nozzle of the lance;

(c) passing the lance through the slot in the safety cage such that the nozzle is contained within the cage and the rod extends outwardly through the slot;

(d) connecting the lance to a source of high pressure water which flow is regulated by a valve; and (e) placing the cage over a tube with the open bottom of the cage resting against flat surface formed by the ends of the tubes, inserting the lance into the tube, opening the valve, and discharging high pressure water into tube.

2. The method of claim 1 wherein slot of the safety cage has a width greater than the diameter of the rod and less than the diameter of the nozzle.

3. The method of claim 2 wherein the safety cage has a weight of at least about five pounds.

4. The method of claim 3 wherein the top of the safety cage is perforated.

5. The method of claim 1 wherein the safety cage additionally comprises a sleeve that slides along the slot, the sleeve having a diameter greater than the rod and less than the nozzle.

* * * * *